United States Patent [19]

Murata et al.

[11] Patent Number: 4,507,184

[45] Date of Patent: Mar. 26, 1985

[54] METHOD FOR FINISHING MATTED SURFACE ON A METAL-MADE ARTICLE FOR PERSONAL ORNAMENT

[75] Inventors: Toshio Murata, Tokyo; Hachiro Kushida, Saitama; Kenji Irie, Kanagawa, all of Japan

[73] Assignee: Citizen Watch Co., Ltd., Tokyo, Japan

[21] Appl. No.: 664,298

[22] Filed: Oct. 24, 1984

[30] Foreign Application Priority Data

Nov. 16, 1983 [JP] Japan ..... 58-215701

[51] Int. Cl.[3] ..... C25F 3/16

[52] U.S. Cl. ..... 204/129.35; 204/129.65

[58] Field of Search ..... 204/129.65, 129.6, 129.35, 204/129.1, 129.75; 156/651, 652, 656, 664

[56] References Cited

U.S. PATENT DOCUMENTS

| | | | |
|---|---|---|---|
| 3,347,760 | 10/1967 | McKelvie | 204/129.35 |
| 3,386,901 | 6/1968 | Young | 204/129.35 |
| 4,437,956 | 3/1984 | Coates | 204/129.35 |

*Primary Examiner*—Thomas Tufariello

*Attorney, Agent, or Firm*—Hopgood, Calimafde, Kalil, Blaustein & Judlowe

[57] ABSTRACT

The invention provides a means for solving the difficult problem of the deposition of stain in the recesses to cause loss of beautiful appearance on the matted surface of an article for personal ornament made of titanium, zirconium or an alloy thereof formed by honing or barrel finishing. The method comprises the steps of (a) forming a first matted surface with microscopically fine protrusions and recesses on the article by honing or barrel finishing, (b) forming a hardened layer on the matted surface by nitriding, carbonizing, boriding or oxidizing, (c) partially removing the hardened layer covering the protrusions on the matted surface by a first electrolytic or chemical polishing, (d) forming a second matted surface on the article by honing or barrel finishing, and (e) partially removing the surface layer at the protrusions by a second electrolytic or chemical polishing to smoothen the surface leaving a sandy appearance.

1 Claim, 6 Drawing Figures

METHOD FOR FINISHING MATTED SURFACE ON A METAL-MADE ARTICLE FOR PERSONAL ORNAMENT

BACKGROUND OF THE INVENTION

The present invention relates to a method for finishing a matted surface on a metal-made article for personal ornament or, more particularly, relates to a method for finishing a matted surface of an article for personal ornament made of titanium, zirconium or an alloy thereof to render the surface insusceptible to stain.

As is known, titanium, zirconium and alloys thereof have been used widely in space rockets and chemical plants by virtue of many excellent properties inherent thereto such as the outstandingly small specific gravity, high corrosion resistance, high specific strength, i.e. ratio of tensile strength to density, and the like. In recent years, however, the application fields of these metals and alloys are expanding also in the fields of metal-made articles for personal ornament such as watch cases, watch straps, bracelets, rings, brooches, pendants and the like. In respect of the surface finishing of such articles for personal ornament, major current of the recent preference of people is in the matted surface with dull or sandy appearance having extremely fine ruggedness, i.e. microscopically tiny protrusions and recesses, on the surface formed by honing or barrel finishing.

A problem in such a matted surface in general is the susceptibility of the surface to stain due to the deposition of perspiration or other excretions from the human skin as in the fingerprints as well as other dirts in the recesses or cavities on the finely rugged matted surface while such a dirty material can hardly be removed to completeness so that dirty spots are sometimes left on the surface to a great loss of the beautiful appearance. In this regard, it is proposed to provide a coating on the matted surface with, for example, a silicone fluid but such a coating material is readily removed away with a detergent or an alcoholic solvent so that no durable effect can of course be expected in such a means.

SUMMARY OF THE INVENTION

It is therefore an object of the present invention to provide a method for finishing a matted surface on an article for personal ornament made of titanium, zirconium or an alloy thereof according to which the finished surface of the article is outstandingly insusceptible to stain so that the beautiful appearance of the ornamental article can be retained lastingly for a long period of time.

Thus, the method of the present invention for finishing a matted surface of a metal-made article for personal ornament comprises the steps of:

(a) forming a first matted surface with fine protrusions and recesses on the article by honing or barrel finishing;

(b) forming a hardened layer on the matted surface by nitriding, carbonizing, boriding or oxidizing;

(c) partially removing the hardened layer covering the protrusions on the matted surface by a first electrolytic or chemical polishing;

(d) forming a second matted surface on the article by honing or barrel finishing; and (e) partially removing the surface layer at the protrusions by a second electrolytic or chemical polishing to smoothen the surface leaving a sandy appearance.

DETAILED DESCRIPTION OF THE PREFERRED EMBODIMENTS

Each of the above mentioned steps (a) to (e) is now described in detail with reference to FIGS. 1*a* to 1*e* illustrating the enlarged cross sectional view of the surface portion of an ornamental article, such as a watch case made of titanium, zirconium or an alloy thereof, under finishing according to the inventive method.

Figure 1A:
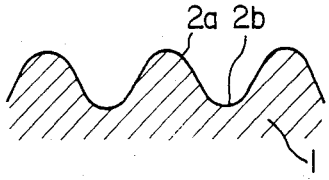
FIGS. 1*a* to 1*e* are each a schematic illustration of the enlarged cross sectional view of the matted surface after one of the above mentioned steps (a) to (e), respectively.

FIG. 1*a* illustrates a schematic cross sectional view of the surface portion of a titanium-made watch case after the step (a) by honing or barrel finishing by use of abrasive grains or glass beads showing numberless microscopically tiny protrusions 2*a* and recesses 2*b* formed on the substrate article 1 giving an appearance of the matted surface. The ruggedness in this case is usually around 100 μm on an average and the matted surface having such a ruggedness is highly susceptible to the deposition of stain in the recesses 2*b* which can hardly be removed away to completeness by a conventional cleaning means.

Figure 1B:
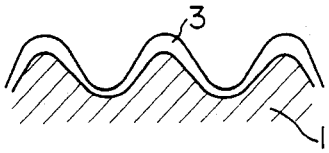
Figure 2:
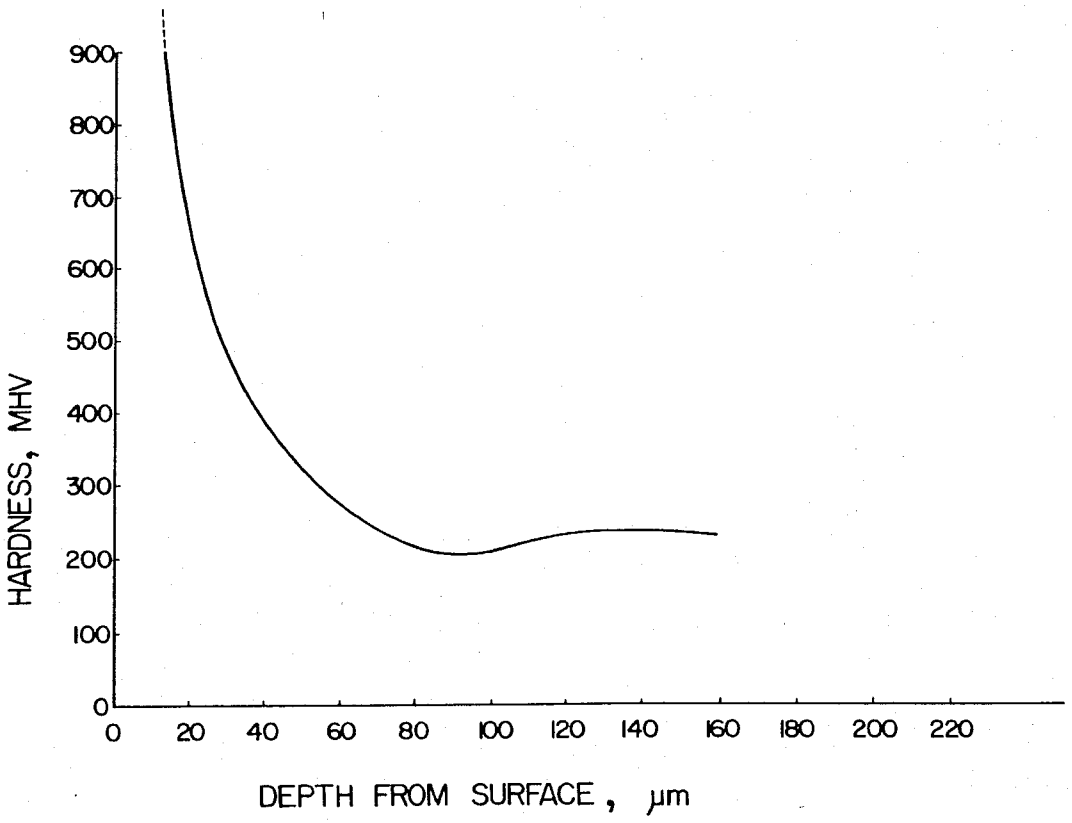
FIG. 2 is a graphic showing of the hardness of the matted surface layer on the article after the hardening treatment by nitriding as a function of the depth from the surface.

FIG. 1*b* illustrates the surface portion after the step (b) in which the matted surface obtained in the step (a) is subjected to a treatment for forming a hardened layer 3 on the surface. The hardening method in this case is typically nitriding and the article is heated in an atmosphere of nitrogen gas at about 850° C. for about 20 hours. FIG. 2 graphically shows the distribution of hardness in the surface layer hardened by nitriding as a function of the depth from the surface. As is understood from FIG. 2, the hardness is the highest at the very surface and rapidly decreases as the depth from the surface increases to substantially level off at about 100 μm of depth. Meanwhile, watch cases should have a surface hardness of about 900 to 1100 HV so that the surface layer of only about 10 μm thickness from the surface has an adequate hardness required for watch cases.

Although the above mentioned process of nitriding has the best adaptability to the industrial production, the method of surface hardening is not limited thereto but may be carbonizing, boriding or oxidizing. These methods of course give different results of surface hardening in respect of the surface hardness, specific gravity of the hardened surface layer and the appearance of the titanium article in the color tone as is summarized below so that a suitable method should be selected according to desire.

| Compound of surface layer | Hardness HV | Specific gravity, g/cm$^3$ | Color tone |
|---|---|---|---|
| TiN | 1770 | 5.44 | Golden yellow |
| $TiB_2$ | 2710 | 4.52 | White |
| TiC | 2470 | 4.92 | White |
| $TiO_2$ | 1000 | 4.26 | Light yellow |

Figure 1C:
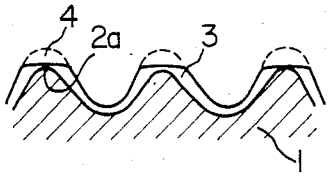

FIG. 1*c* illustrates the cross section of the surface portion after the step (c) in which portions 4 below the dotted line curves of the hardened surface layer 3 has been partially removed from the tops of the protrusions 2*a* by means of electrolytic or chemical polishing. In the electrolytic polishing, the electric current is concentrated at the tops of the protrusions where the electrolytic erosion first takes place to decrease the ruggedness of the matted surface. This situation is similar also in the chemical polishing in which the matted surface is etched by use of an etching solution which is typically a mixture of hydrofluoric acid and nitric acid. At any rate, care must be taken so that the removal of the hardened layer 3 is limited at the top portions 4 of the protrusions 2*a*.

Figure 1D:
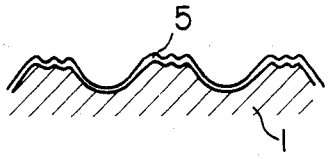

The thus electrolytically or chemically polished surface is then subjected to a second treatment by honig or barrel finishing with abrasive grains or glass beads. This treatment is performed only to a slight extent so that the destruction of the hardened layer 3 takes place only in the very vicinity of the surface to form finer ruggedness 5 than in the first honing or barrel finishing in the step (a) as is illustrated in FIG. 1*d* by the cross section. The average ruggedness or roughness in this case is about 10 μm. Care must be taken also in this step not to cause exposure of the surface of the substrate 1 by the complete destruction of the hardened layer 3.

Figure 1E:
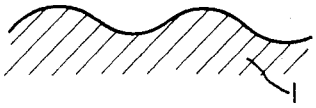

Finally in the step (e), the matted surface is subjected to a second electrolytic or chemical polishing in a similar manner to the step (c) to remove away the surface layer so that the matted surface is imparted with smoothness as a whole as is illustrated in FIG. 1*e* by the cross section. The maximum surface roughness $H_{max}$ on the thus finished matted surface is decreased to about 5 μm which is much smaller than the $H_{max}$ value of about 150 μm after the step (a) so that any stain or dirty material deposited on the surface can easily be wiped away and the beautiful appearance of the metal-made articles for personal ornament can be retained everlastingly.

What is claimed is:

1. A method for finishing a matted surface of a metal-made article for personal ornament which comprises the steps of:

(a) forming a first matted surface with fine protrusions and recesses on the article by honing or barrel finishing;

(b) forming a hardened layer on the matted surface by nitriding, carbonizing, boriding or oxidizing;

(c) partially removing the hardened layer covering the protrusions on the matted surface by a first electrolytic or chemical polishing;

(d) forming a second matted surface on the article by honing or barrel finishing; and (e) partially removing the surface layer at the protrusions by a second electrolytic or chemical polishing to smoothen the surface leaving a sandy appearance.

* * * * *